United States Patent [19]

Brown

[11] 4,125,751

[45] Nov. 14, 1978

[54] MICROWAVE OVEN CONTROL CIRCUIT

[75] Inventor: Clayton D. Brown, Cochituate, Mass.

[73] Assignee: Raytheon Company, Lexington, Mass.

[21] Appl. No.: 755,697

[22] Filed: Dec. 30, 1976

[51] Int. Cl.[2] ..... H05B 9/00; H05B 37/02; H05B 39/04

[52] U.S. Cl. ..... 219/10.55 B; 315/102; 315/151; 315/158

[58] Field of Search ..... 219/10.55 B; 315/151, 315/158, 102, 279; 331/62, 66, 91, 186, 176; 323/21; 328/2, 8, 10, 270, 9, 11, 259, 258; 330/145

[56] References Cited

U.S. PATENT DOCUMENTS

| | | | |
|---|---|---|---|
| 1,970,411 | 8/1934 | Andrews | 315/158 |
| 2,262,044 | 11/1941 | Philpott | 315/151 |
| 2,805,385 | 9/1957 | McBean | 323/66 |
| 2,915,659 | 12/1959 | Goodman | 313/471 |
| 3,092,755 | 4/1958 | Goodman | 315/158 |
| 3,396,342 | 8/1968 | Feinberg | 219/10.55 B |
| 3,412,227 | 11/1968 | Anderson | 219/10.55 B |
| 3,549,942 | 12/1970 | Nijholt | 315/102 |
| 3,591,826 | 7/1971 | Valles | 219/10.55 B |
| 3,611,017 | 10/1971 | Freeland | 219/10.55 B |

*Primary Examiner*—J. V. Truhe
*Assistant Examiner*—Bernard Roskoski
*Attorney, Agent, or Firm*—M. D. Bartlett; J. D. Pannone; H. W. Arnold

[57] ABSTRACT

A microwave oven control circuit in which the filament of a magnetron supplying microwave energy to the oven is heated to its electron emitting temperature around 1500° C where it emits red spectrum radiation which is sensed by a photoconductive element through the magnetron microwave output structure to produce a control signal actuating the magnetron high voltage supply.

9 Claims, 1 Drawing Figure

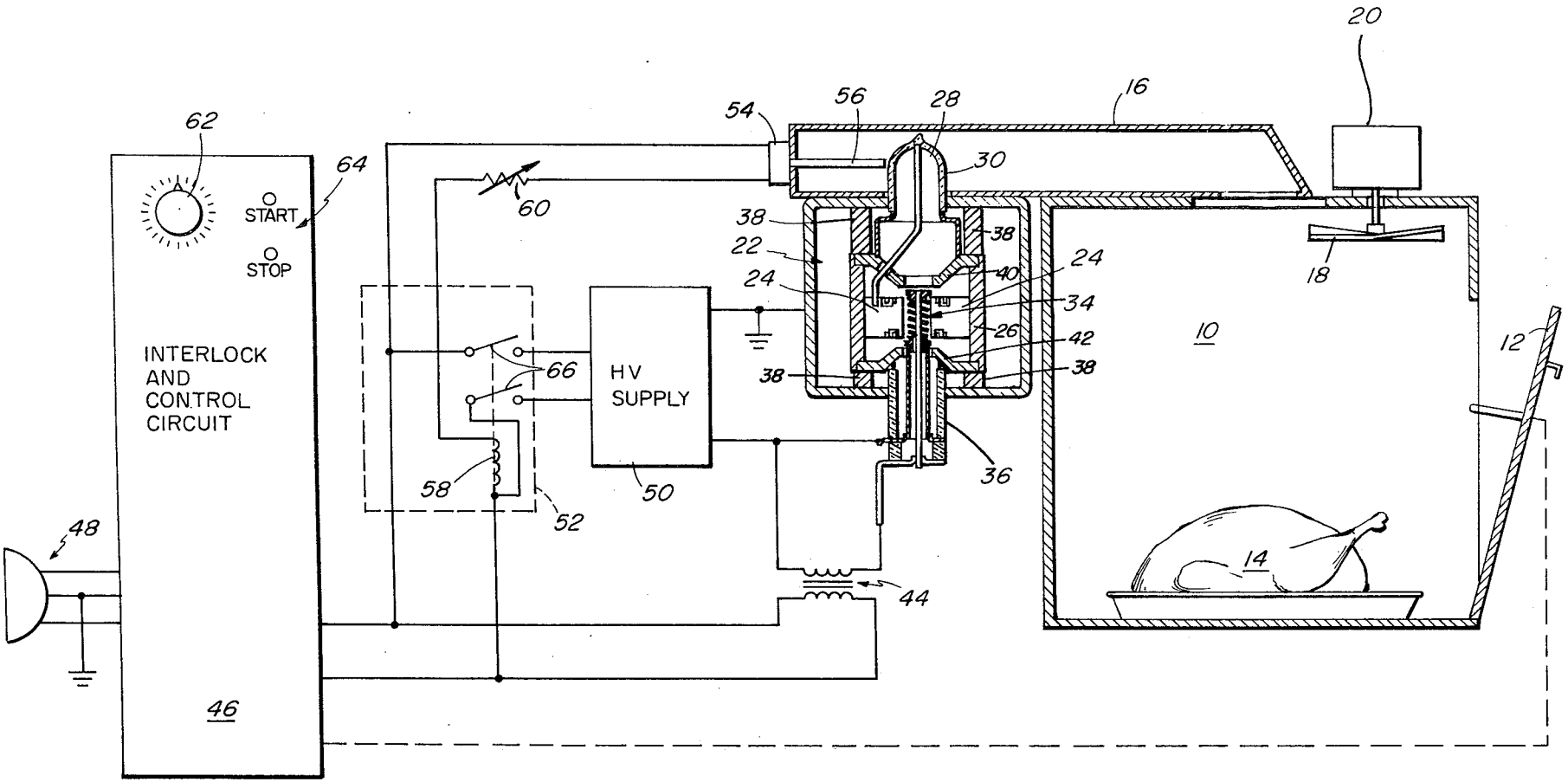
HV SUPPLY
INTERLOCK AND CONTROL CIRCUIT
START
STOP

MICROWAVE OVEN CONTROL CIRCUIT

BACKGROUND OF THE INVENTION

Microwave ovens are supplied microwave energy from generators such as magnetrons using electron emission structures such as cathodes or directly heated filaments with high voltage applied between filaments and anode structures, the high voltage being supplied by transformers which produce a relatively wide range of output voltages dependent upon the load, such load dependent characteristics permitting relatively constant operation of the magnetron over a substantial range of input voltages. Such power supplies produce substantial output voltage differences between conditions where no current flows in the magnetron due, for example, to insufficient temperature of the electron source or to an open connection and conditions where a magnetron is properly heated and generating a normal microwave output. It has previously been the practice to supply a filament transformer energized immediately upon turning on the microwave oven, with the high voltage supply being supplied through a time delay of several seconds to turn on the high voltage supply after the magnetron filament has been heated to electron emitting temperature. Such time delays are expensive and are a source of failure. In addition, if there is a failure of the magnetron due, for example, to filament burnout, loss or emission or an open connection, the time delay does not sense such failure and activates the high voltage power supply. Also, as the magnetron heater initially heats up with high voltage applied, magnetron moding can occur in which the magnetron operates in a mode other than the fundamental anode resonant mode which results in excess current being drawn and/or overheating of the filament, for example, by excess back bombardment of electrons.

SUMMARY OF THE INVENTION

In accordance with this invention, the temperature of the electron emission structure such as the filament, or the cathode, of the magnetron is sensed by detecting radiation therefrom and using such radiation as a measure of the time delay following application of heater power before high voltage is applied to the magnetron.

More specifically, this invention provides for detecting radiation in the red or infrared region of the radiation spectrum by sensing such radiation passing out through the microwave output structure of the magnetron as reflections off metal portions of the magnetron anode and output structure.

This invention further provides that the red spectrum radiation may be detected by a photoresponsive structure positioned outside a waveguide into which the microwave energy from the magnetron is coupled, with such red radiant energy being detected by a light pipe extending through an aperture in the waveguide from a photoresponsive structure outside the waveguide to a point adjacent the output structure of the magnetron.

BRIEF DESCRIPTION OF THE DRAWING

Other and further objects and advantages of the invention will become apparent as the description thereof progresses, reference being had to the accompanying drawing wherein the drawing illustrates a microwave oven having a power control circuit embodying the invention.

DESCRIPTION OF THE PREFERRED EMBODIMENT

Referring to the drawing, there is shown a microwave oven comprising a cavity 10 having a door 12 through which bodies to be heated, such as food body 14, may be positioned in the oven. Microwave energy is supplied to the cavity 10 via a waveguide structure 16, and the particular mode patterns in the oven are varied by means of a mode stirrer structure 18 driven by a motor 20, in accordance with well-known practice.

Microwave energy is generated by a magnetron 22 comprising a magnetron anode containing vanes 24 attached to a cylindrical shell 26 to form a cavity anode, in accordance with well-known practice. A microwave output structure comprises a conductor 28 connected to one of the vanes and extending into a dielectric output seal member 30 extending into waveguide 16 so that microwave energy is radiated from output probe 28 through seal 30 into the waveguide and, hence, into the oven cavity 10.

A directly heated filament 34 is positioned in the central bore of the magnetron defined by the vanes and is insulatingly sealed from the anode structure by seal 36. A permanent magnet structure 38 produces a magnetic field across the space between pole pieces 40 and 42 and in the presence of said magnetic field and a D.C. voltage applied between filament 34 and anode vanes 24, electrons from the cathode circle the cathode and produce oscillations of the magnetron.

Heater power for the filament 34 is supplied by a filament transformer 44 which is supplied with power from an interlock and control circuit 46 supplied with 60-cycle 110-volt power from a conventional wall plug 48. The D.C. voltage of, for example, 4000 volts is produced between the filament 34 and the anode vanes 24 by a conventional high voltage supply 50 whose input is supplied through contacts 66 of a relay 52 controlled by a photoconductor 54 positioned outside waveguide 16.

Photoconductor 54 responds to radiation, preferably in the red or infrared region of the spectrum between 0.1 and 1 micrometers produced by the heated filament 34 and its support or end shield structure. Such radiations pass through output dielectric seal 30 and are picked up by light pipe 56 of, for example, plastic, which extends through an aperture in waveguide 16 and couples a portion of said radiation to photoconductor 54.

The voltage from the output of interlock and control circuit 46 is connected in series with the coil 58 of relay 52, the photoconductor 54 and a variable resistor 60. Resistor 60 is adjusted to a value which allows sufficient current to flow through coil 58 to actuate relay 52 to close contacts 66 of relay 52 and thereby energize D.C. supply 50 when the temperature of filament 34 is heated to the minimum desired operating temperature of, for example, 1500° C. thereby emitting the necessary infrared radiation to reduce the resistance of photoconductor 54.

In operation, a food body 14 is placed in cavity 10 and door 12 is closed, mechanically closing an interlock switch or switches in interlock and control circuit 46. A timer 62 is set to the desired time of cooking and a start button 64 in circuit 46 is pushed, producing a voltage at the output of control circuit 46 which is applied to transformer 44 to heat filament 34. This voltage is also applied to relay coil 58 in series with resistor 60 and with photoconductor 54 which has a high resistance. After a period of a few seconds, filament 34 which may be, for example, thoriated tungsten, reaches a temperature of, for example, 1500° C. at which electron emission from filament 34 is sufficient to produce stable microwave operation by the magnetron 22. This temperature, which may be selected in the range between 1200° C. and 1600° C. by adjusting resistor 60, produces radiations over a wide spectrum having a substantial component in the red region of the spectrum and producing a sufficient reduction in the resistance of photo conductor 54 to actuate relay 52, closing contacts 66 and connecting power to high voltage supply 50 which applies a negative voltage to filament 34.

High voltage supply 50 may comprise a conventional magnetron supply shown, for example, in U.S. Pat. No. 3,396,342 issued on Aug. 6, 1968 to A. E. Feinberg having a saturable transformer with leakage reactance whose secondary is connected in series with a condenser sized for optimum line voltage regulation and a rectifier to the grounded anode of magnetron 22, the junction between condenser and rectifier being connected to filament 34 to form a modified voltage doubler. Due among other things to said voltage doubler characteristic, the power supply can produce voltage peaks many thousand volts above normal when the filament is below its normal operating temperature. Such voltage peaks also appear across the anode and filament of magnetron 22.

Thus, it may be seen that by ensuring that magnetron 22 has its filament in electron emitting condition, the voltage output of power supply 50 will not exceed its rated value, and voltage breakdown of the magnetron and/or power supply is avoided. Furthermore, generation of spurious output frequencies due, for example, to moding or other phenomenon associated with low electron emission from the filament 34 may be prevented.

This completes the description of the embodiment of the invention illustrated herein. However, many modifications thereof will be apparent to persons skilled in the art without departing from the spirit and scope of this invention. For example, a wide range of photosensors can be used for the photoconductor 54, radiations from the filament 34 could be sensed from specially designed apertures in the magnetron 22 or through apertures in the filament support. In addition, the relay 52 is illustrated by way of example only and a semiconductor switch such as a thyristor could be used, and the power supply 50 could be a super audible switching frequency power supply. Accordingly, it is intended that the invention be not limited to the particular details of the embodiment described herein except as defined by the appended claims.

What is claimed is:

1. A microwave oven comprising:

a cavity;

a structure for coupling microwave energy to said cavity from a microwave generator having an electron source and an anode;

means for supplying a voltage between said electron source and said anode;

means for sensing radiation from said electron source at frequencies substantially above the frequency of said microwave energy; and means responsive to said sensing means for controlling the supply of said voltage between said electron source and said anode of said microwave generator.

2. The microwave oven in accordance with claim 1 wherein said microwave generator comprises a magnetron.

3. The microwave oven in accordance with claim 1 wherein said electron sources comprises a directly heated filament.

4. The microwave oven in accordance with claim 3 wherein the application of power to said filament is controlled by means for controlling the operation of said microwave oven and said voltage is supplied between said electron source and said anode when said filament is heated to a temperature where said radiation source exceeds a predetermined value.

5. In combination:

a source of microwave energy comprising an electron source and an anode;

means for supplying a voltage between said electron source and said anode;

means for heating said electron source to produce emission of electrons therefrom and radiation from said electron source at frequencies substantially higher than the frequency of said microwave source;

means for coupling said microwave energy to a body to be heated; and means responsive to the radiation from said electron source for controlling the supply of said voltage between said anode and said source.

6. The combination in accordance with claim 5 wherein said microwave source comprises a magnetron.

7. The combination in accordance with claim 6 wherein said means responsive to said radiation comprises a radiation responsive structure responsive to radiation in the red region of the spectrum.

8. The combination in accordance with claim 7 wherein said radiation responsive structure comprises a photoconductive element.

9. The combination in accordance with claim 5 wherein said means for coupling said energy to said body to be heated comprises a microwave oven cavity containing said body to be heated.

* * * * *